US010406656B2

(12) United States Patent
Wang

(10) Patent No.: US 10,406,656 B2
(45) Date of Patent: Sep. 10, 2019

(54) CLAMP

(71) Applicants: Hangzhou Great Star Tools Co., Ltd., Hangzhou (CN); Hangzhou Great Star Industrial Co., Ltd., Hangzhou (CN)

(72) Inventor: Min Wang, Hangzhou (CN)

(73) Assignees: Hangzhou Great Star Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 110 days.

(21) Appl. No.: 15/547,156

(22) PCT Filed: Jan. 29, 2015

(86) PCT No.: PCT/CN2015/071786

§ 371 (c)(1),
(2) Date: Jul. 28, 2017

(87) PCT Pub. No.: WO2016/119154

PCT Pub. Date: Aug. 4, 2016

(65) Prior Publication Data

US 2018/0021926 A1 Jan. 25, 2018

(51) Int. Cl.
*B25B 7/10* (2006.01)
*B25B 7/12* (2006.01)
(Continued)

(52) U.S. Cl.
CPC ..... *B25B 7/10* (2013.01); *B25B 7/08* (2013.01); *B25B 7/12* (2013.01); *B25B 7/14* (2013.01)

(58) Field of Classification Search
CPC .... B25B 7/10; B25B 7/08; B25B 7/12; B25B 7/14; B25B 7/00; B25B 13/22; B25B 13/36
See application file for complete search history.

(56) References Cited

U.S. PATENT DOCUMENTS

| | | | | |
|---|---|---|---|---|
| 1,145,067 | A | 7/1915 | Kelly | |
| 2001/0007214 | A1 | 7/2001 | Liou | |
| 2007/0044317 | A1 * | 3/2007 | Critelli | B23D 29/02 30/173 |

FOREIGN PATENT DOCUMENTS

| | | | |
|---|---|---|---|
| CN | 2743084 | Y | 11/2005 |
| CN | 101428406 | A | 5/2009 |

(Continued)

OTHER PUBLICATIONS

International Search Report for International Patent Application No. PCT/CN2015/071786 dated Nov. 5, 2015.

(Continued)

*Primary Examiner* — Robert J Scruggs

(74) *Attorney, Agent, or Firm* — Andrus Intellectual Property Law, LLP

(57) ABSTRACT

A clamp, including a first clamp body and a second clamp body. The first clamp body includes a first clamp jaw and a first handle, movably connected to each other. The first clamp jaw is rotatably connected to the second clamp body at a first connecting position, and the first handle is rotatably connected to the second clamp body at a second connecting position. When the relative position of the first clamp jaw and the first handle is changed, a force occurs between the first clamp jaw and the first handle. A moment formed by the force with the first connecting position as a fulcrum is greater than a moment formed by the force with the second connecting position as a fulcrum.

16 Claims, 8 Drawing Sheets

(51) Int. Cl.
*B25B 7/14* (2006.01)
*B25B 7/08* (2006.01)

(56) References Cited

FOREIGN PATENT DOCUMENTS

| | | | |
|---|---|---|---|
| CN | 201940914 | U | 8/2011 |
| CN | 203390768 | U | 1/2014 |
| DE | 130913 | C | 3/1901 |
| DE | 29816558 | U1 | 1/1999 |

OTHER PUBLICATIONS

European Search Report for EP Application No. 15879362.0, dated Sep. 6, 2018.

* cited by examiner

CLAMP

CROSS-REFERENCE TO RELATED APPLICATIONS

This application is the U.S. national stage application of International Application PCT/CN2015/071786, filed Jan. 29, 2015, which international application was published on Aug. 4, 2016, as International Publication WO 2016/119154 A1 in the English language.

FIELD OF THE INVENTION

The present invention relates to a hand tool, and more particularly, to a clamp.

DESCRIPTION OF THE PRIOR ART

A clamp is a relatively small and light hand tool product and is widely used for household non-professional emergency or simple article clamping or mounting. Generally, a clamp has a pair of clamp bodies and each of the clamp bodies comprises a clamp jaw and a handle. The pair of clamp bodies is pivotally connected to each other with a connection point being between the clamp jaw and the handle. A part as a pivot is generally movable on one of clamp bodies to adjust the opening width between the clamp jaws. When in use, an object is placed between the clamp jaws, a hand applies a force on the handles, and the clamp jaws provide a clamping force based on the lever law.

From a standpoint of labor-saving when the tool is applied, theoretically, further labor-saving can be achieved only by extending the handles or shortening the clamp jaws, namely, increasing the length of power arms or decreasing the length of resistance arms in the lever law. Since the length of the clamp jaws is determined by the object to be clamped, generally the manufacturers extend the handle sections for the purpose of labor-saving in use of a water pump clamp. However, considering convenience in actual use, the length of the handles cannot be increased without limitation. The extension of the handles directly results in increase in the opening distance between holding points of the handles, and even inconvenience in one-handed operation if exceeding a certain degree. Even with two-handed operation, if space is limited, inconvenience in use is still present.

Thus, how to achieve the effect of further labor-saving without changing the handle length (or the tool size) is a main technical problem to be solved by the present invention, and it is further desirable to be able to rapidly, easily and reliably adjust the opening width between the clamp jaws.

SUMMARY OF THE INVENTION

In order to achieve the above objects, the present invention provides a clamp having a labor-saving structure, which achieves the effect of further labor-saving by the structural arrangement thereof without increasing the length of the handle sections, compared to the clamp having the conventional structure. Also, the present invention provides a water pump clamp having this labor-saving structure and provided with a structure facilitating adjustment of an opening width between clamp jaws.

A clamp according to the present invention, comprising a first clamp body and a second clamp body, characterized in that the first clamp body comprises a first clamp jaw and a first handle, movably connected to each other; the first clamp jaw is rotatably connected to the second clamp body at a first connecting position, and the first handle is rotatably connected to the second clamp body at a second connecting position; when the relative position of the first clamp jaw and the first handle is changed, a force occurs between the first clamp jaw and the first handle; and a moment formed by the force with the first connecting position as a fulcrum is greater than a moment formed by the force with the second connecting position as a fulcrum.

Further, a limiting structure is disposed on one of the first clamp jaw and the first handle, and a limiting member to be engaged with the limiting structure is disposed on the other of the first clamp jaw and the first handle. The limiting member is partially or completely disposed within the limiting structure and is movable within the limiting structure, to form movable connection between the first clamp jaw and the first handle.

Further, the limiting structure is an elongated hole or slot, and the limiting member is movable along the length direction of the elongated hole or slot.

The present invention further provides a clamp, comprising a first clamp body and a second clamp body, characterized in that the first clamp body comprises a first clamp jaw and a first handle, movably connected to each other; the first clamp jaw is rotatably connected to the second clamp body at a first connecting position, and the first handle is rotatably connected to the second clamp body at a second connecting position; when the relative position of the first clamp jaw and the first handle is changed, a force occurs between the first clamp jaw and the first handle; a moment formed by the force with the first connecting position as a fulcrum is greater than a moment formed by the force with the second connecting position as a fulcrum; the second clamp body comprises a limiting region, a limiting block is disposed within the limiting region and is movable within the limiting region, and the first connecting position and the second connecting position are disposed on the limiting block.

Further, the limiting region is an elongated hole or slot.

Further, the first clamp jaw is pivotally connected to the limiting block.

Further, the first handle is pivotally connected to the limiting block.

Further, the second clamp body comprises a second clamp jaw and a second handle, and the limiting region is disposed between the second clamp jaw and the second handle.

Further, the first connecting position is closer to the second clamp jaw than the second connecting position.

Further, the limiting region comprises a locking structure, and a locking portion to be engaged with the locking structure is disposed on the limiting block. When the locking structure is engaged with the locking portion, the position of the limiting block within the limiting region is kept fixed, at which point the limiting block is in a locked position, and when the locking structure is disengaged from the locking portion, the limiting block is movable within the limiting region, at which point the limiting block is in a released position.

Further, the locking structure is a tooth-shaped profile, and the locking portion is a tooth to be engaged with the tooth-shaped profile.

Further, an elastic member is disposed on the limiting block, and the elastic member holds the limiting block in the locking position.

Further, the elastic member is a spring.

Further, the elastic member is disposed at a position engagable with the first handle, so as to resist a force from the elastic member by driving the first handle, thereby driving the limiting block to the released position.

Further, the distance of the elastic member to the first connecting position is greater than the distance of the elastic member to the second connecting position.

Further, the tooth-shaped profile and/or the limiting block is disposed such that when the limiting block is moved toward the second clamp jaw, a force from the tooth-shaped profile on the tooth moves the limiting block to the released position; and when the limiting block is moved toward the second handle, a force from the tooth-shaped profile on the tooth holds the limiting block in the locking position.

Further, the clamp is a water pump clamp.

Unlike to the conventional clamp in which only one lever system is adapted, the labor-saving clamp according to the present invention creatively adapts two lever systems, such that equivalent force arms in actual use are increased without changing the handle length (or the tool size), achieving the purpose of labor-saving. It has a simple structure and is easy to implement, and desired equivalent force arms can be obtained by adjusting the shape or length of the components in design, and the opening width between the clamp jaws can also be quickly adjusted, which is simple in operation and reliable in use.

The concept, specific structure and technical effect of the present invention will be further described below in connection with the accompanying drawings, in order to fully understand the objects, features and effect of the present invention.

DETAILED DESCRIPTION OF THE PREFERRED EMBODIMENTS

Figure 10:
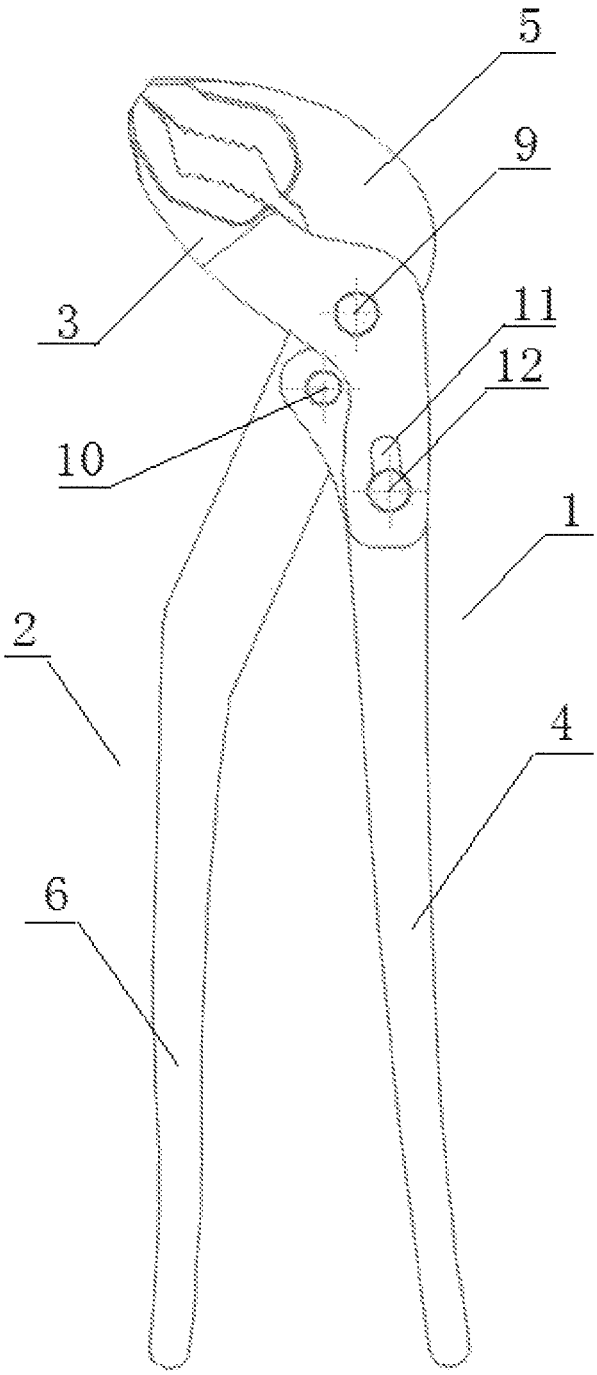
FIG. 10 is a schematic view of one preferred embodiment of a clamp according to the present invention.

As shown in FIG. 10, a clamp according to the present invention comprises a first clamp body 1 and a second clamp body 2. The first clamp body 1 comprises a first clamp jaw 3 and a first handle 4, and the second clamp body 2 comprises a second clamp jaw 5 and a second handle 6. The second clamp body 2 is pivotally connected to the first clamp jaw 3 by a rivet 9 (a first connecting position), and the second clamp body 2 is pivotally connected to the first handle 4 by a rivet 10 (a second connecting position). An elongated hole 11 is disposed on the first clamp jaw 3, and the first clamp jaw 3 and the first handle 4 are connected by a rivet 12 passing through the elongated hole 11, to form movable connection between the first clamp jaw 3 and the first handle 4. By the arrangement above, rotatable connection is achieved between the second clamp body 2 and the first clamp jaw 3 and between the second clamp body 2 and the first handle 4.

In addition, many variations are possible for the above structures. For example, the elongated hole 11 may be replaced by a slot providing the same effect; the elongated hole 11 may be disposed on the first handle 4, and the position of the rivet 12 relative to the first clamp jaw 3 is kept fixed, and so on.

The structural arrangement of the clamp having a labor-saving system has been described above, and the clamp has the labor-saving effect because two lever systems are involved, i.e. one lever system with the first clamp jaw 3 as a lever and the rivet 9 as a shaft, and the other lever system with the first handle 4 as a lever and the rivet 10 as a shaft. The force transmission of the two lever systems is achieved by the elongated hole 11 and the rivet 12.

FIG. 1 to FIG. 5 show a water pump clamp having the abovementioned labor-saving structure according to the present invention, comprising a first clamp body 1 and a second clamp body 2. The first clamp body 1 comprises a first clamp jaw 3 and a first handle 4, and the second clamp body 2 comprises a second clamp jaw 5, a second handle 6, and an elongated hole 7. The elongated hole 7 is disposed between the second clamp jaw 5 and the second handle 6, and a tooth block 8 is disposed within the elongated hole 7.

Figure 4:
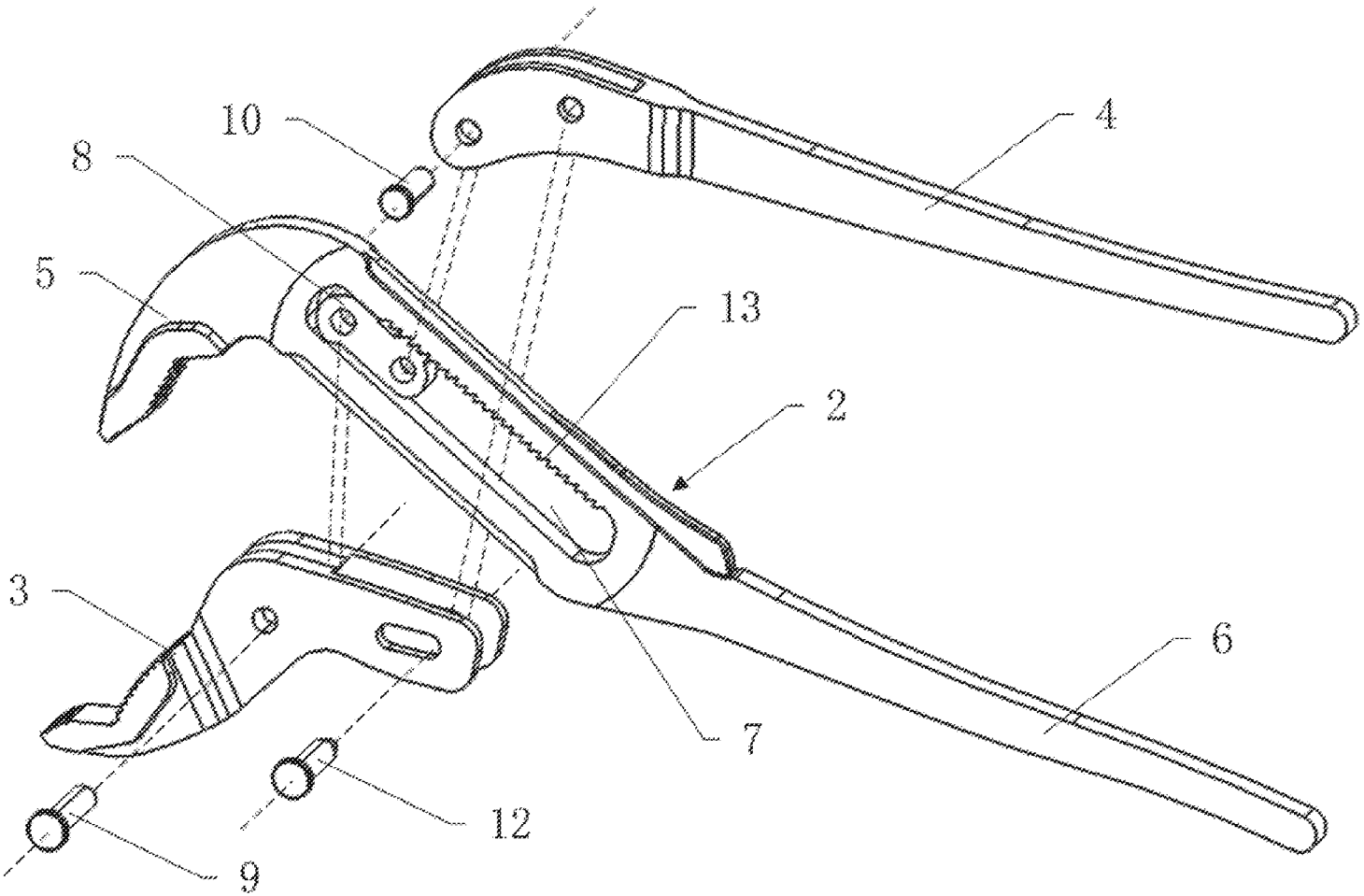
FIG. 4 is an exploded view of elements of the water pump clamp shown in FIG. 1.

As shown in FIG. 4, the second clamp body 2 passes through between bifurcations on the first clamp jaw 3 and the first handle 4, and then the first clamp jaw 3 is pivotally connected to the tooth block 8 by a rivet 9, and the first handle 4 is pivotally connected to the tooth block 8 by a rivet 10. In this way, the tooth block 8 is limited in the elongated hole 7, is not movable in an axial direction of the pivots (the rivet 9 and the rivet 10) and is only movable within the elongated hole 7 in a radial direction.

Figure 1:
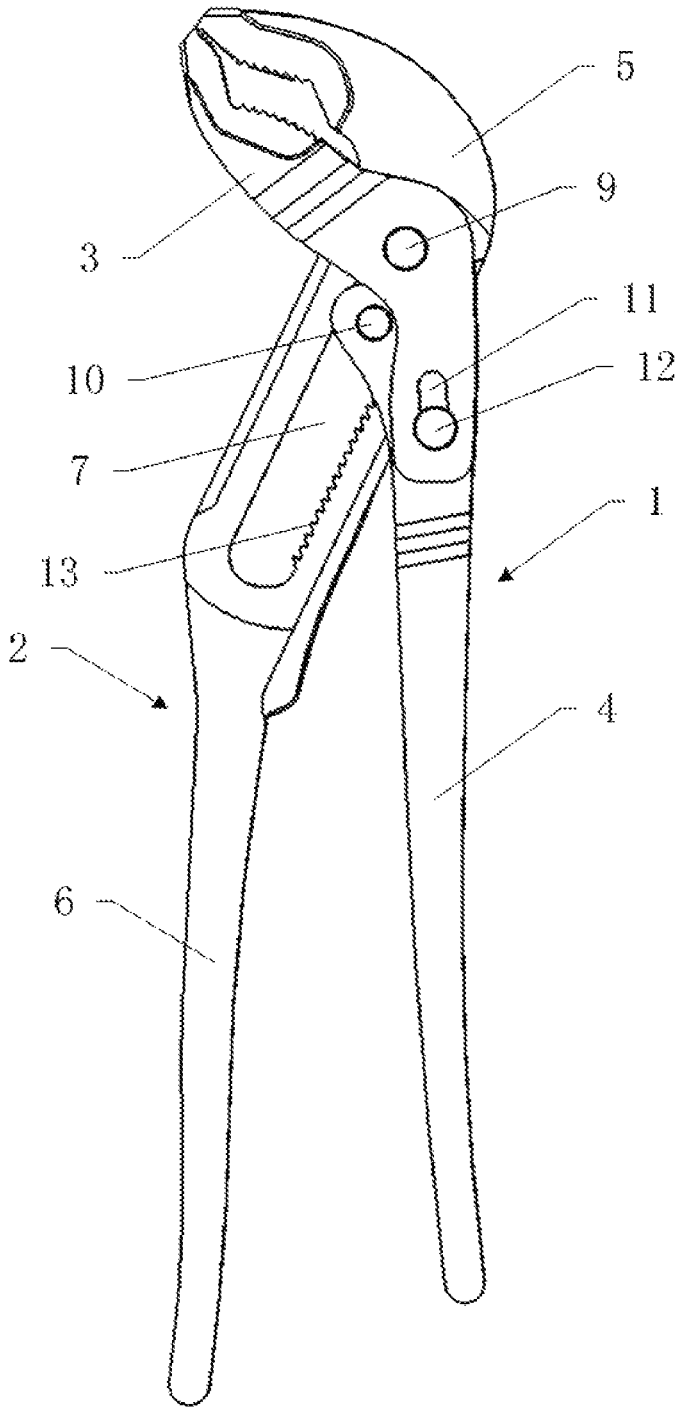
FIG. 1 is a schematic view of one preferred embodiment of a water pump clamp according to the present invention.
Figure 2:
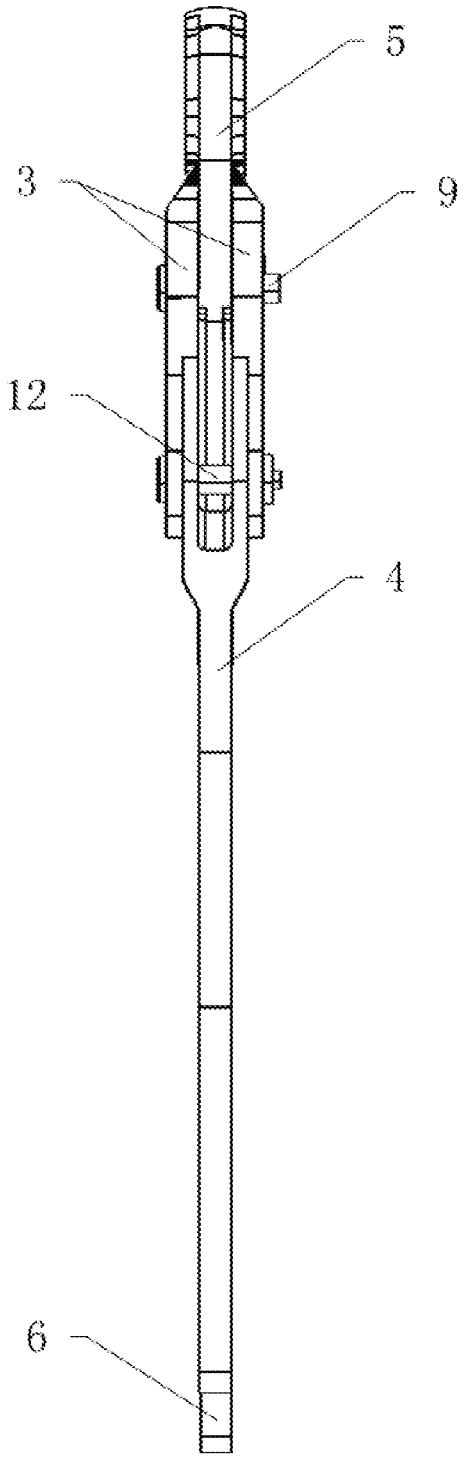
FIG. 2 is a right view of the water pump clamp shown in FIG. 1.
Figure 3:
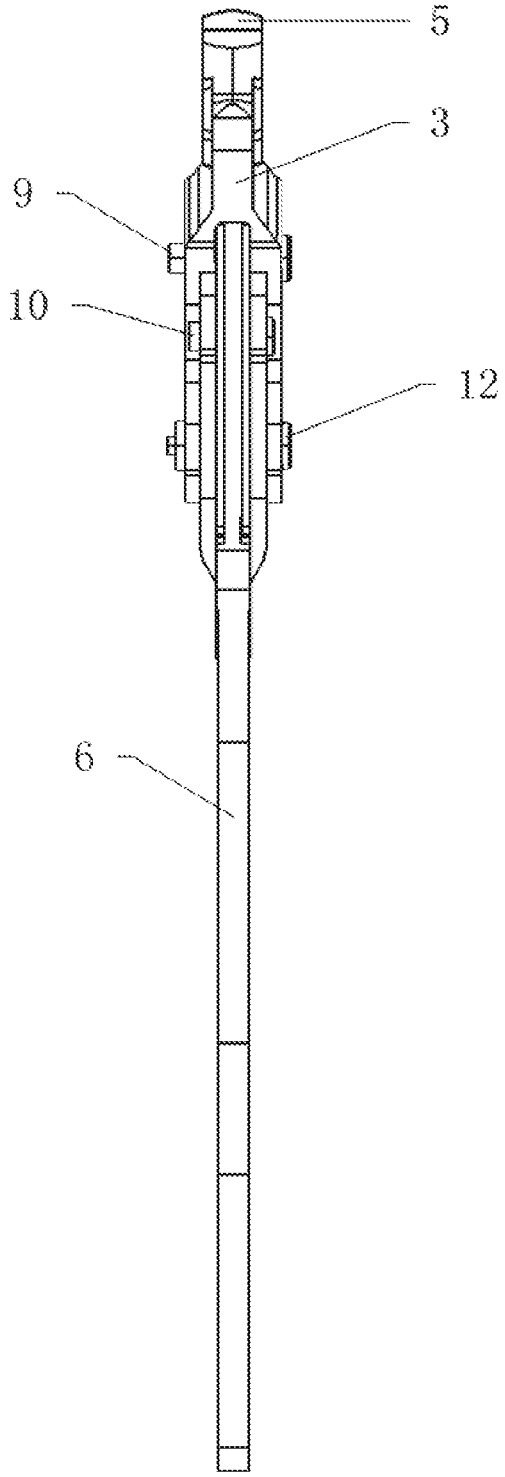
FIG. 3 is a left view of the water pump clamp shown in FIG. 1.
Figure 5:
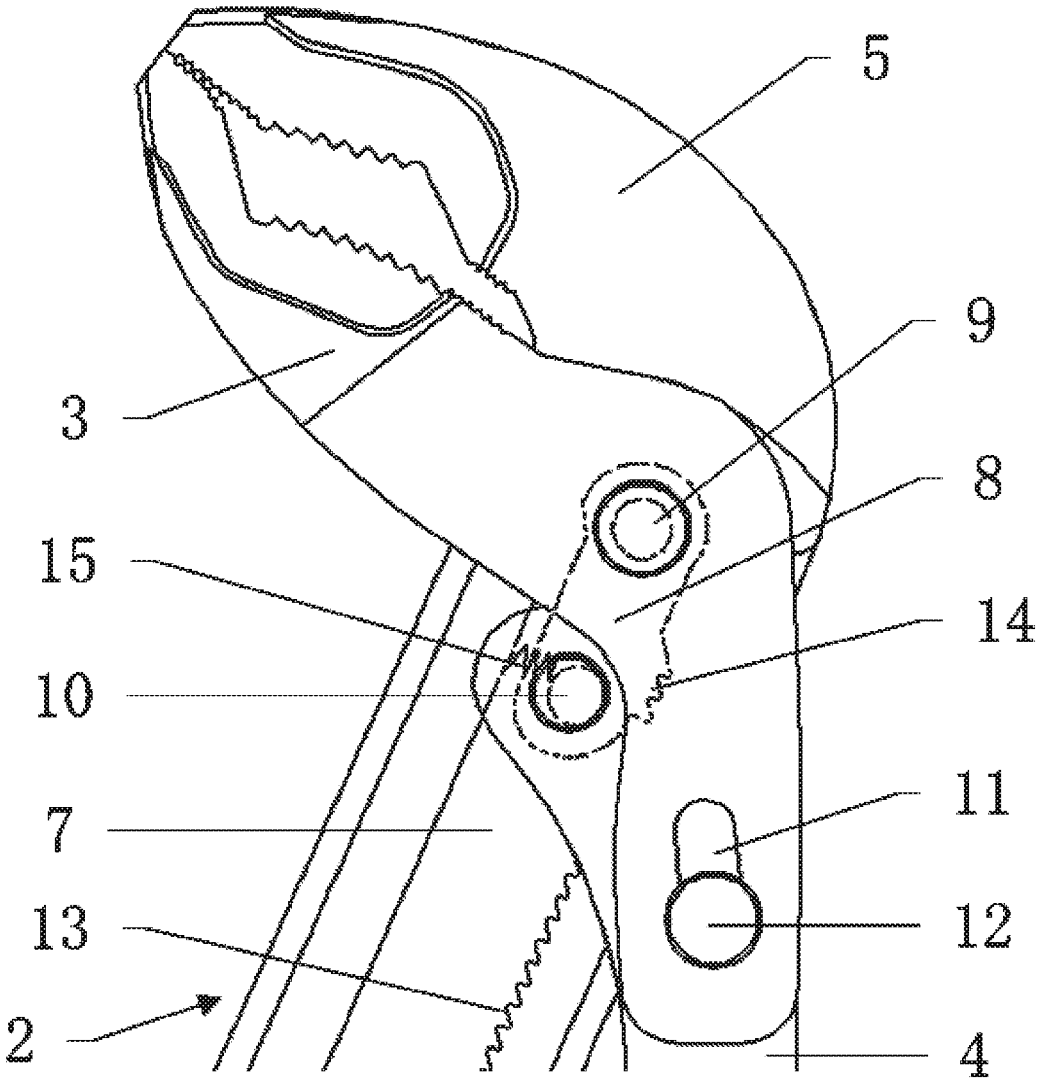
FIG. 5 is a partially enlarged view of the water pump clamp shown in FIG. 1.

FIG. 5 is a partially enlarged view of the interconnects of the first clamp jaw 3, the first handle 4 and the tooth block 8 in FIG. 1, in which the tooth block 8 being shielded is shown in a dashed line. On the tooth block 8, the rivet 9 is closer in position to the second clamp jaw 5 than the rivet 10.

An elongated hole 11 is disposed on the first clamp jaw 3, and the first clamp jaw 3 and the first handle 4 are connected by a rivet 12 passing through the elongated hole 11, to form movable connection between the first clamp jaw 3 and the first handle 4. By the arrangement above, rotatable connection is achieved between the second clamp body 2 and the first clamp jaw 3 and between the second clamp body 2 and the first handle 4.

The position of the rivet 12 relative to the first handle 4 is kept fixed, and the rivet 12 is movable within the elongated hole 11 relative to the first clamp jaw 3. In this example, the rivet 12 is movable along the length direction of the elongated hole 11. The position of the rivet 12 in the elongated hole 11 varies with the relative position of the first clamp jaw 3 and the first handle 4.

In addition, many variations are possible for the above structures. For example, the elongated hole 11 and the elongated hole 7 may be replaced by slots providing the same effect; the elongated hole 11 may be disposed on the first handle 4, and the position of the rivet 12 relative to the first clamp jaw 3 is kept fixed, and so on.

The structural arrangement of the water pump clamp having a labor-saving system has been described above, and the labor-saving effect thereof is further explained by the force analysis in the state shown in FIG. 1.

Figure 6:
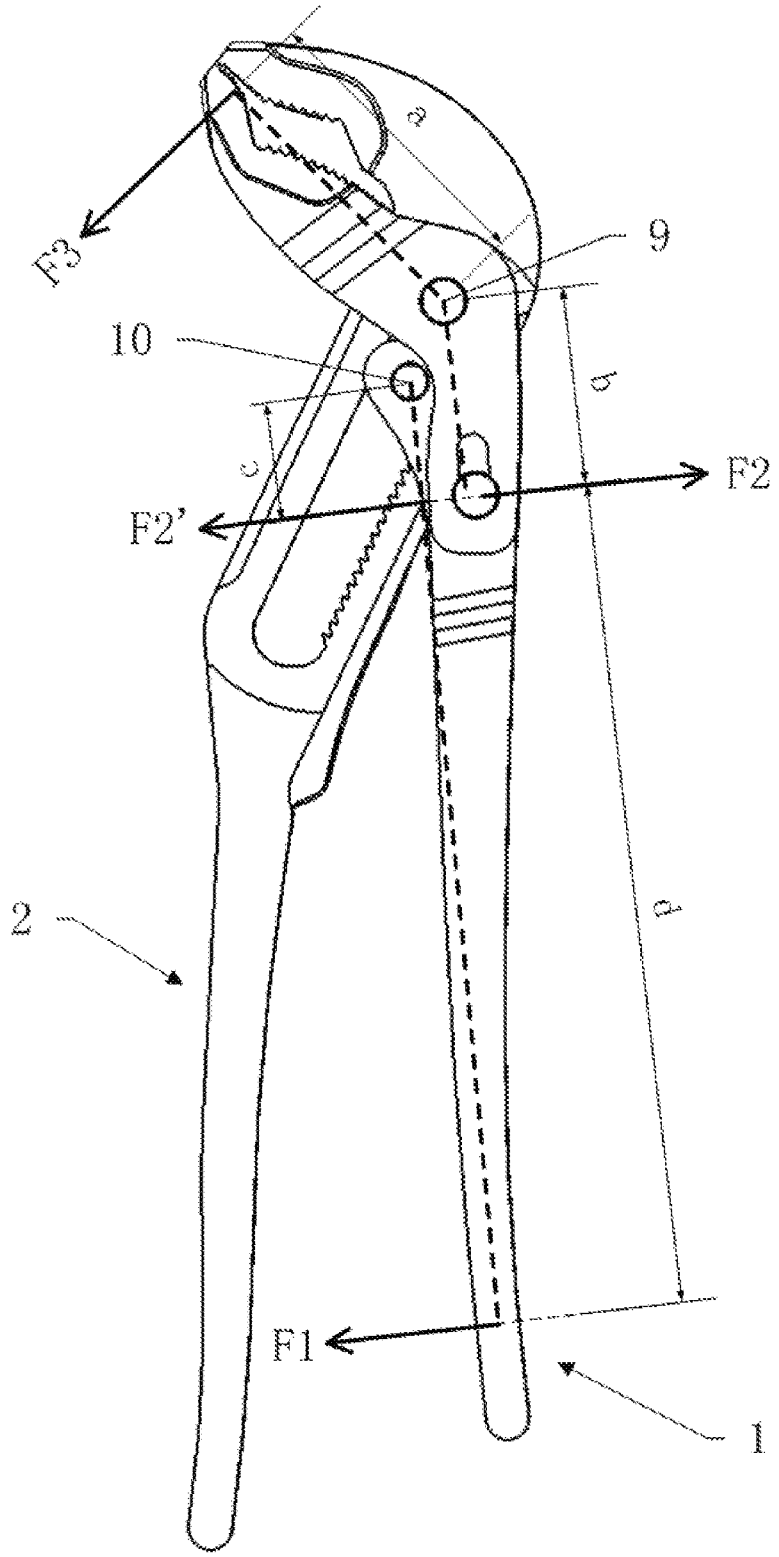
FIG. 6 is a force analysis diagram of the water pump clamp shown in FIG. 1.

FIG. 6 is a force analysis diagram of the water pump clamp shown in FIG. 1, in which two lever systems are involved, i.e. one lever system with the first clamp jaw 3 as a lever and the rivet 9 as a shaft, and the other lever system with the first handle 4 as a lever and the rivet 10 as a shaft. The force transmission of the two lever systems is achieved by the elongated hole 11 and the rivet 12.

In FIG. 6, F1 is a force applied to the first handle 4; F2 and F2' are a force and a reaction force between the first clamp jaw 3 (particularly the elongated hole 11) and the first handle 4 (particularly the rivet 12); and F3 is a reaction force acted onto the first clamp jaw 3 from the second clamp jaw 5 (the force comes from an object being champed when the object is champed between the clamp jaws).

In the lever system with the first clamp jaw 3 as a lever and the rivet 9 as a shaft, F3 and F2' are involved, that have force arms a and b respectively, and it can be known from the lever law that $$F2'\times b=F3\times a \tag{1}$$

In the lever system with the first handle 4 as a lever and the rivet 10 as a shaft, F1 and F2 are involved, that have force arms c+d and c respectively, and it can be known from the lever law that $$F1\times(c+d)=F2\times c \tag{2}$$

And, F2 and F2' are a force and a reaction force between the first clamp jaw 3 (particularly the elongated hole 11) and the first handle 4 (particularly the rivet 12), and thus $$F2=F2' \tag{3}$$

It can be obtained from the formulas (1), (2) and (3) that $$F3\times a=F1\times(c+d)\times(b/c) \tag{4}$$

Given the tool size remains unchanged, if the water pump clamp is disposed with only one lever system, namely, the first clamp jaw is fixedly connected to the first handle and connected to the tooth block by only one pivot, according to the change in position of the pivot on the tooth block, the maximum of the force arm of the handle at one end is b+d (with the rivet 9 as the pivot). Substituting the results calculated for the lever system according to the lever law into the formula (4), in this case, whether it is assumed that the forces applied to the handles by the two water pump clamps are the same, or it is assumed that the clamping forces at the clamp jaws are the same, it can be calculated that as long as b is larger than c, the water pump clamp using the double-lever system will be more labor-saving than the water pump clamp using the single-lever system. That is, where the handle length (or the tool size) is unchanged, when the same force is applied to the handles, the water pump clamp using the double-lever system can provide a greater clamping force; and when the clamp jaws are at the same clamping force, the force required to be applied to the handles is smaller for the water pump clamp using the double-lever system.

The results of force analysis of the water pump clamp of the present invention in various opening states all are consistent with the conclusions above.

An adjusting structure of the opening width between the clamp jaws of the water pump clamp is described in detail below.

As shown in FIG. 1, FIG. 4, FIG. 5, and FIG. 7, a tooth-shaped profile 13 is disposed at one side within the elongated hole 7, and a tooth 14 to be engaged with the tooth-shaped profile 13 is provided on the tooth block 8. A spring 15 is disposed at the other side on the tooth block 8 opposite to the tooth 14, and the spring 15 is located at one end close to the rivet 10. Under the action of the spring force of the spring 15, the tooth 14 on the tooth block 8 is engaged with the tooth-shaped profile 13, to achieve the locking of the tooth block 8 within the elongated hole 7.

Since the spring 15 is disposed at the end close to the rivet 10, the tooth block 8 can be driven by the first handle 4 to compress the spring 15 such that the tooth-shaped profile 13 is disengaged from the tooth 14. At this time, the tooth block 8 can be driven by the first handle 4 to slide within the elongated hole 7.

In the present embodiment, the locking manner between the tooth-shaped profile 13 and the tooth block 8 is further structurally disposed such that when the spring 15 is not compressed by the first handle 4 and the tooth block 8 can be only driven to move toward the second clamp jaw 5, a force by the tooth-shaped profile 13 on the tooth 14 can compress the spring 15 to disengage the tooth-shaped profile 13 from the tooth 14; when the spring 15 is not compressed by the first handle 4 and the tooth block 8 can be only driven to move toward the second handle 6, the force by the tooth-shaped profile 13 on the tooth 14 allows the tooth-shaped profile 13 and the tooth 14 to be retained in engagement.

Figure 7:
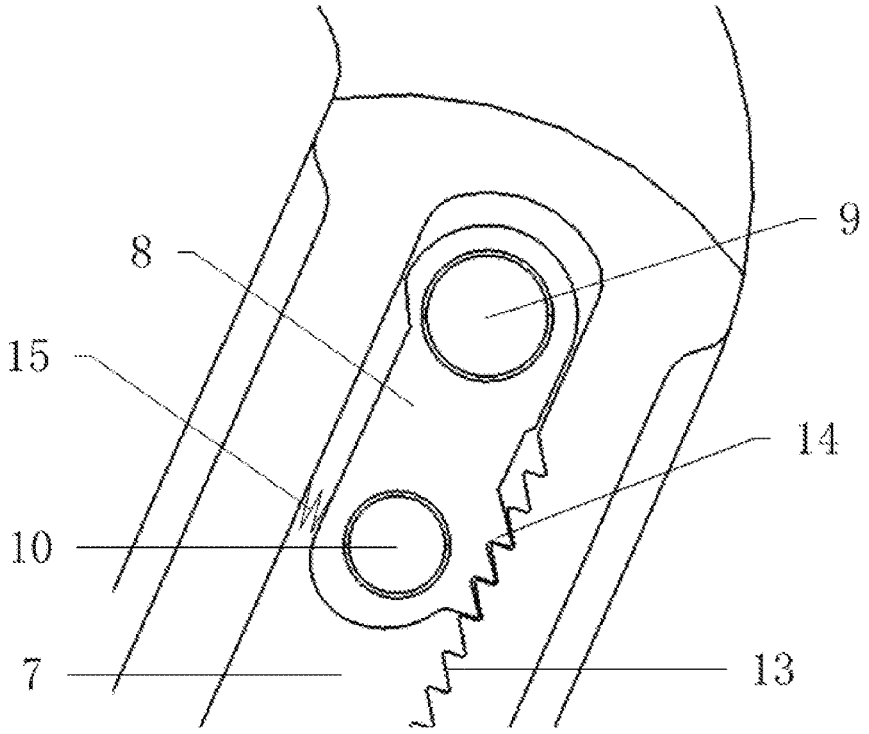
FIG. 7 is a partially enlarged view of a tooth block-mounting position on the water pump clamp shown in FIG. 1.
Figure 8:
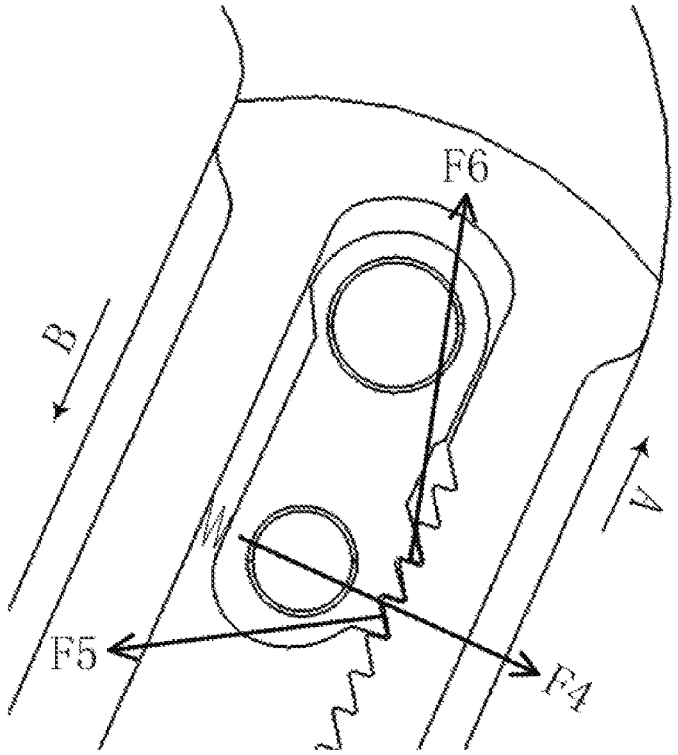
FIG. 8 is a force analysis diagram of the tooth block shown in FIG. 7 when moving.

FIG. 8 is a force analysis diagram of the tooth block 8 shown in FIG. 7 when translating in the elongated hole 7. When the tooth block 8 is driven to translate toward the second clamp jaw 5 (i.e. in a direction A in the figure), with the rivet 9 as the shaft, a force F4 by the spring 15 on the tooth block 8 rotates the tooth block 8 counterclockwise, and a force F5 acted onto the tooth 14 on the tooth block 8 from the tooth-shaped profile 13 rotates the tooth block 8 clockwise, namely, the rotation directions of the tooth block 8 by F4 and F5 are opposite to each other. Thus, as long as the force F5 applied is larger than the force F4, the tooth block 8 will be rotated clockwise, such that the tooth block 8 can be driven to translate toward the second clamp jaw 5, namely, the adjustment in position of the tooth block 8 can be achieved, during which no force is required to be directly applied to the spring 15 to compress it.

Likewise, in FIG. 8, when the tooth block 8 is driven to translate toward the second handle 6 (i.e. in a direction B in the figure), with the rivet 9 as the shaft, the force F4 by the spring 15 on the tooth block 8 rotates the tooth block 8 counterclockwise, and a force F6 acted onto the tooth 14 on the tooth block 8 from the tooth-shaped profile 13 rotates the tooth block 8 counterclockwise. That is, when the water pump clamp is under stress, a resultant force of the force acted on the tooth 14 on the tooth block 8 and the force acted on the tooth-shaped profile 13 must ensure the tendency of counterclockwise rotation of the tooth block 8, in order to ensure the force applied to the held object by the water pump clamp. Namely, F4 and F6 cause the tooth block 8 to have the tendency of counterclockwise rotation, to maintain the engagement of the tooth-shaped profile 13 and the tooth 14. Thus, if it is desired to disengage the two from each other, an external force must be applied to compress the spring such that the tooth block 8 is rotated clockwise to disengage the tooth-shaped profile 13 from the tooth 14, and then quickly translated toward the second handle 6.

Such a structural design enables the water pump clamp to achieve fast adjustment in a single direction, facilitating rapid clamping of an object to be clamped; when it is desired to open, a pushing force is firstly applied to the first clamp jaw 3 by the first handle 4, and then the first clamp jaw 3 is moved in the direction B after the tooth-shaped profile 13 is disengaged from the tooth 14, such that separation movement of the first clamp jaw 3 and the second clamp jaw 5 occurs.

After understanding the above principles, by changing the structures of the elongated hole 7 (including the tooth-shaped profile 13) or/and the tooth block 8, convenient movement of the tooth block 8 in both directions can be easily achieved, facilitating adjustment of the opening width between the clamp jaws.

Figure 9:
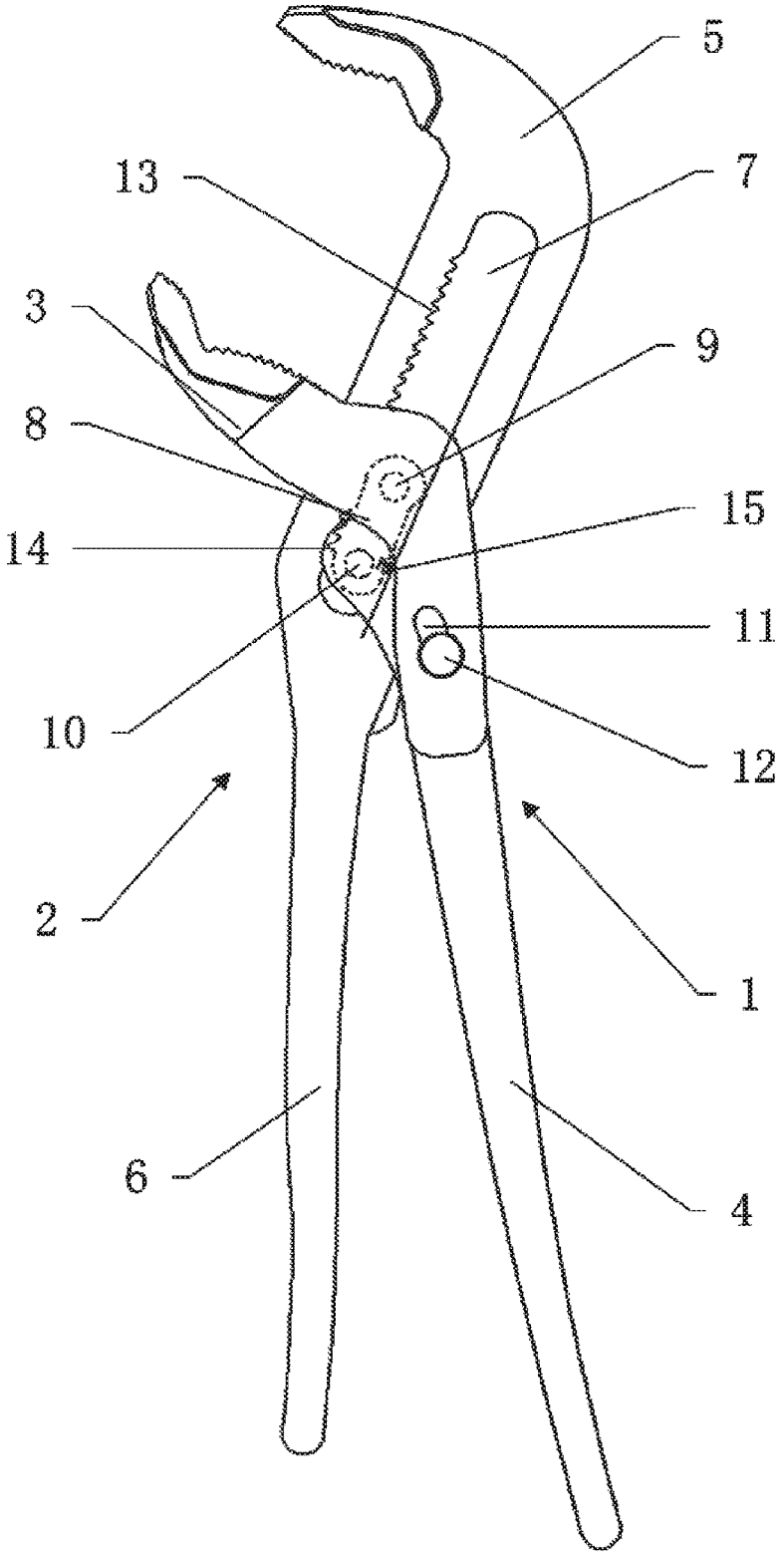
FIG. 9 is a schematic view of another preferred embodiment of the water pump clamp according to the present invention.

FIG. 9 is another preferred embodiment of the present invention, similar to the embodiment above, in which the tooth block 8 and the spring 15 being shielded are shown in dashed lines. The difference from the embodiment above is only that the tooth-shaped profile 13 is disposed on the other opposite side and accordingly, the position of the tooth 14 on the tooth block 8, the position of the spring 15 and the shape of the tooth-shaped profile 13 all are correspondingly adjusted according to the this change in position. In the present embodiment, when it is desired to compress the spring 15, a force is applied to the first handle 4 away from the second clamp body 2, while in the previous embodiment, a force is applied to the first handle 4 toward the second clamp body 2.

Preferred particular embodiments of the present invention have been described in detail above. It will be appreciated that various variations and modifications can be made by those of ordinary skill in the art according to the concept of the present invention without creative efforts. Thus, technical solutions that can be obtained by those skilled in the art according to the concept of the present invention based on the prior art by logic analyses, deductions, or limited experiments, all shall fall within the scope defined by the claims.

The invention claimed is:

1. A clamp, comprising a first clamp body and a second clamp body, wherein the first clamp body comprises a first clamp jaw and a first handle movably connected to each other; the first clamp jaw is rotatably connected to the second clamp body at a first connecting position, and the first handle is rotatably connected to the second clamp body at a second connecting position; when the relative position of the first clamp jaw and the first handle is changed, a force occurs between the first clamp jaw and the first handle; and a moment formed by the force with the first connecting position as a fulcrum is greater than a moment formed by the force with the second connecting position as a fulcrum; the second clamp body comprises a limiting region, a limiting block is disposed within the limiting region and is movable within the limiting region, and the first connecting position and the second connecting position are disposed on the limiting block.

2. The clamp of claim 1, wherein a limiting structure is disposed on one of the first clamp jaw and the first handle, and a limiting member to be engaged with the limiting structure is disposed on the other of the first clamp jaw and the first handle, the limiting member is partially or completely disposed within the limiting structure and is movable within the limiting structure, to form movable connection between the first clamp jaw and the first handle.

3. The clamp of claim 2, wherein the limiting structure is an elongated hole or slot, the limiting member is movable along the length direction of the elongated hole or slot.

4. The clamp of claim 1, wherein the limiting region is an elongated hole or slot.

5. The clamp of claim 1, wherein the first clamp jaw is pivotally connected to the limiting block.

6. The clamp of claim 1, wherein the first handle is pivotally connected to the limiting block.

7. The clamp of claim 1, wherein the second clamp body comprises a second clamp jaw and a second handle, the limiting region is disposed between the second clamp jaw and the second handle.

8. The clamp of claim 7, wherein the first connecting position is closer to the second clamp jaw than the second connecting position.

9. The clamp of claim 7, wherein the limiting region comprises a locking structure, and a locking portion to be engaged with the locking structure is disposed on the limiting block, when the locking structure is engaged with the locking portion, the position of the limiting block within the limiting region is kept fixed, at which point the limiting block is in a locked position, and when the locking structure is disengaged from the locking portion, the limiting block is movable within the limiting region, at which point the limiting block is in a released position.

10. The clamp of claim 9, wherein the locking structure is a tooth-shaped profile, and the locking portion is a tooth to be engaged with the tooth-shaped profile.

11. The clamp of claim 10, wherein an elastic member is disposed on the limiting block, the elastic member holding the limiting block in the locking position.

12. The clamp of claim 11, wherein the elastic member is a spring.

13. The clamp of claim 11, wherein the elastic member is disposed at a position engagable with the first handle, so as to resist a force from the elastic member by driving the first handle, thereby driving the limiting block to the released position.

14. The clamp of claim 13, wherein the distance of the elastic member to the first connecting position is greater than the distance of the elastic member to the second connecting position.

15. The clamp of claim 11, wherein the tooth-shaped profile and/or the limiting block is disposed such that when the limiting block is moved toward the second clamp jaw, a force from the tooth-shaped profile on the tooth moves the limiting block to the released position; and when the limiting block is moved toward the second handle, a force from the tooth-shaped profile on the tooth holds the limiting block in the locking position.

16. The clamp of claim 1, wherein the clamp is a water pump clamp.

* * * * *